US007567776B2

(12) United States Patent
Inoue et al.

(10) Patent No.: US 7,567,776 B2
(45) Date of Patent: Jul. 28, 2009

(54) FIXING DEVICE AND IMAGE FORMING APPARATUS

(75) Inventors: Tohru Inoue, Kanagawa (JP); Aya Kakishima, Kanagawa (JP); Atsumi Kurita, Kanagawa (JP); Tetsuo Yamada, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 207 days.

(21) Appl. No.: 11/586,626

(22) Filed: Oct. 26, 2006

(65) Prior Publication Data

US 2007/0116501 A1 May 24, 2007

(30) Foreign Application Priority Data

Nov. 24, 2005 (JP) ..... P2005-339274

(51) Int. Cl.
*G03G 15/20* (2006.01)
*H05B 3/00* (2006.01)

(52) U.S. Cl. ..... 399/333; 219/216

(58) Field of Classification Search ..... 219/218, 219/216; 399/320, 328, 333
See application file for complete search history.

(56) References Cited

U.S. PATENT DOCUMENTS 5,331,385 A 7/1994 Ohtsuka et al. ..... 355/290
5,420,679 A 5/1995 Goto et al. ..... 355/285
2002/0006297 A1* 1/2002 Ando ..... 399/333

FOREIGN PATENT DOCUMENTS

JP 6-318005 11/1994
JP 9-222816 8/1997
JP 2001-265144 9/2001

* cited by examiner

*Primary Examiner*—Hoang Ngo
(74) *Attorney, Agent, or Firm*—Morgan, Lewis & Bockius LLP

(57) ABSTRACT

A fixing device includes a heating rotation body, a heat source and a pressurization member. The heating rotation body has an endless peripheral surface that moves circularly. The heat source heats the heating rotation body. The pressurization member is in pressure-contact with the peripheral surface of the heating rotation body to press a recording medium, which passes through a nip between the pressurization member and the heating rotation body, against the peripheral surface of the heating rotation body. The pressurization member includes a base material and plural layers deposited on the base material. A volume resistance of a surface layer forming a surface of the pressurization member is larger than that of a layer disposed just below the surface layer. The layer disposed just below the surface layer is grounded.

18 Claims, 5 Drawing Sheets

FIXING DEVICE AND IMAGE FORMING APPARATUS

BACKGROUND

1. Technical Field

The invention relates to a fixing device for heating and pressurizing a toner image, which is formed by selectively depositing toner on a latent image based on an electrostatic potential difference and transferred onto a recording medium, so as to form a fixed image and an image forming apparatus using the fixing device.

2. Description of the Related Art

In an electrophotographic image forming apparatus, image light is applied to a charged surface of a photosensitive drum. Thereby, an electrostatic latent image is formed. Then, toner is electrostatically transferred to the electrostatic latent image. Thereby, a toner image is formed on the photosensitive drum. Then, the toner image is transferred directly or through an intermediate transfer body to a recording medium and is fixed onto the recording medium.

The following fixing device for fixing an unfixed toner image onto a recording medium has been widely used. That is, the fixing device includes a heating roller, which serves as a heating rotation body and has an endless peripheral surface moving circularly; and a pressurization roller, which serves as a pressurization member for pressing a toner image against the peripheral surface. In this fixing device, the heating roller and the pressurization roller are in pressure-contact with each other and a recording medium on which the toner image is carried is inserted into a pressure-contact portion (nip portion). Accordingly, the recording medium passes through the pressure-contact portion as the heating roller rotates and then, the unfixed toner image is heated and is fixed.

The heating roller for use in such a fixing device often has a hollow cored bar made of aluminum and a heater supported inside the cored bar. A surface of the heating roller is coated with a fluorocarbon resin to enhance releasability. The pressurization roller includes an elastic layer having heat resistance, such as silicone rubber, on a metal cored bar. Since toner transferred to the heating roller, that is, offset toner may be transferred to the back of the recording medium, which makes the back of a recording medium dirty. Therefore, it has been proposed that the pressurization roller is provided with a surface layer based on a fluorocarbon resin on which toner is hard to deposit. For example, the peripheral surface of the pressurization roller is covered with a PFA resin layer shaped like a thin tube.

In the fixing device with the surface of the pressurization roller thus covered with a fluorocarbon resin based material, the surface has high insulation properties and thus the surface of the pressurization roller is charged by friction when a recording medium on which an unfixed toner image is carried passes through the nip portion. Generally, the fluorocarbon resin is charged to the negative polarity by friction between the fluorocarbon resin and paper. When the negative potential on the surface of the pressurization roller becomes high, the negative polarity toner on the recording medium electrically repels between the recording medium and the surface of the pressurization roller. As a result, electrostatic offset, that is, transferring of the toner to the surface of the heating roller easily occurs.

SUMMARY

According to an aspect of the invention, a fixing device includes a heating rotation body, a heat source and a pressurization member. The heating rotation body includes an endless peripheral surface that moves circularly. The heat source heats the heating rotation body. The pressurization member is in pressure-contact with the peripheral surface of the heating rotation body to press a recording medium, which passes through a nip between the pressurization member and the heating rotation body, against the peripheral surface of the heating rotation body. The pressurization member includes a base material and a plurality of layers deposited on the base material. A volume resistance of a surface layer forming a surface of the pressurization member is larger than that of a layer disposed just below the surface layer. The layer disposed just below the surface layer is grounded.

BRIEF DESCRIPTION OF THE DRAWINGS

Exemplary embodiments of the invention will be described in detail below with reference to the accompanying drawings wherein.

DETAILED DESCRIPTION

Referring now to the accompanying drawings, exemplary embodiments of the invention will be described.

Figure 1:
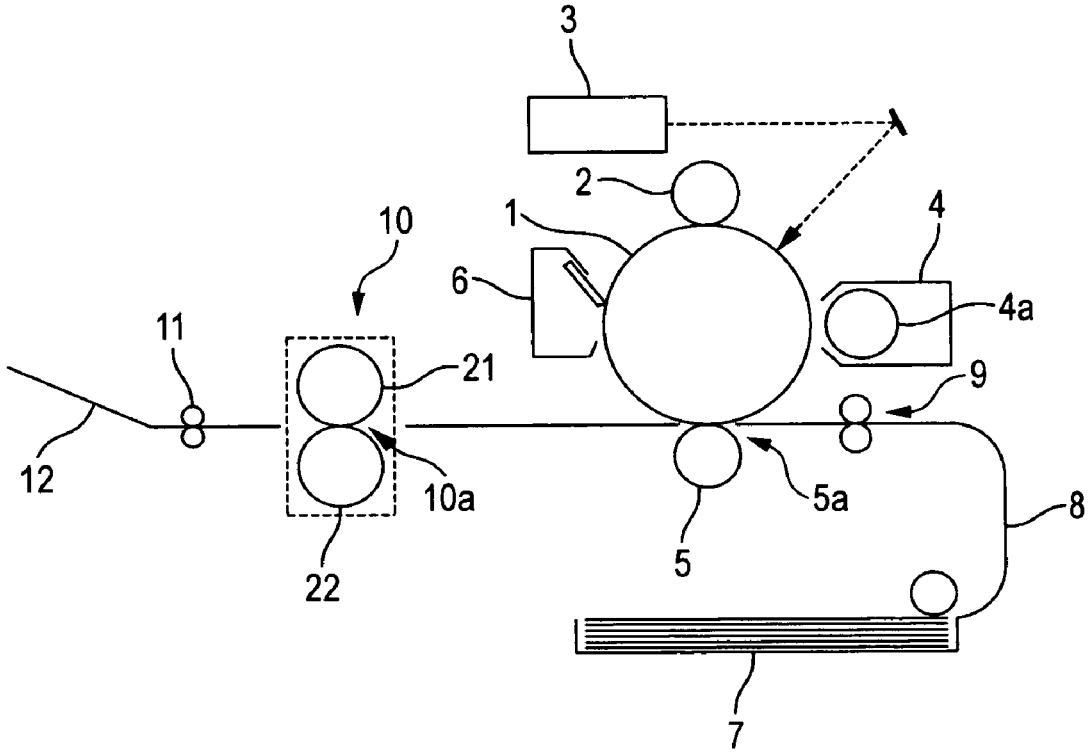
FIG. 1 is a schematic configuration drawing to show an image forming apparatus according to one exemplary embodiment of the invention.

FIG. 1 is a schematic configuration drawing to show an image forming apparatus according to a first exemplary embodiment according to the invention. The image forming apparatus includes a cylindrical photosensitive drum 1 (image carrier). By irradiating the photosensitive drum 1 with image light after the photosensitive drum 1 is uniformly charged, a latent image is formed on the surface of the photosensitive drum 1. In the surroundings of the photosensitive drum 1, a charging device 2, an exposure device 3, a developing device 4, a transfer roller 5 and a cleaning device 6 are disposed. The charging device 2 uniformly charges the surface of the photosensitive drum 1. The exposure device 3 applies the image light to the photosensitive drum 1 to form the latent image on the surface of the photosensitive drum 1. The developing device 4 visualizes the electrostatic latent image formed on the photosensitive drum 1 by selectively depositing toner. The transfer roller 5 transfers the toner image formed on the photosensitive drum 1 to a recording medium by an electric field formed by applying a transfer bias voltage to a nip portion between the transfer roller 5 and the photosensitive drum 1. The cleaning device 6 removes the remaining toner on the photosensitive drum 1 after the toner image is transferred to the recording medium.

The image forming apparatus also includes a paper tray 7, a transport passage 8, a registration roller 9, a fixing device 10 and a paper discharge roller 11. The paper tray 7 stores record media to which a toner image is to be transferred. The transport passage 8 transports the record media, which are fed one by one from the paper tray 7, to a transfer section 5*a*. In the transfer section 5*a*, the photosensitive drum 1 and the transfer roller 5 face each other. The registration roller 9 feeds the transported recording medium into the transfer section 5*a* at a predetermined timing. The fixing device 10 clamps the toner image transferred onto the recording medium in a fixing nip portion 10*a* in which a heating roller 21 and a pressurization roller 22 are in pressure-contact with each other, so as to heat and pressurize the toner image. The paper discharge roller 11 transports the recording medium to a paper discharge tray 12.

The photosensitive drum 1 is provided with a metal drum and a photosensitive layer formed on the surface of the metal drum. The photosensitive layer may be made of various inorganic photosensitive materials, organic photosensitive materials, amorphous selenium based photosensitive material and amorphous silicon based photosensitive material, such as Se, a-Si, a-SiC and Cds.

The charging device 2 includes a conductive metal roller coated with a high-resistance material. The conductive metal roller may be made of stainless steel or aluminum. The charging device 2 is in contact with the photosensitive drum 1 so as to rotate while following rotation of the photosensitive drum 1. When a predetermined voltage is applied to the charging device 2, the charging device 2 continuously discharges in a minute gap in the vicinity of a contact portion between the conductive metal roller and the photosensitive drum 1. As a result, the charging device 2 charges the surface of the photosensitive drum 1 almost uniformly.

The exposure device 3 emits a laser beam, which blinks for each pixel, based on an image signal. The exposure device 3 exposes and scans the peripheral surface of the photosensitive drum 1 to the light beam with using a polygon mirror. Accordingly, the potential of the exposed part attenuates on the peripheral surface of the photosensitive drum 1, and the latent image is formed based on the electrostatic potential difference.

The developing device 4 has a developing roller 4*a* so that the developing roller 4*a* faces and is located in the vicinity of the photosensitive drum 1. A developing bias voltage is applied between the developing roller 4*a* and the photosensitive drum 1. Toner is carried on the peripheral surface of the developing roller 4*a* and is transported to a portion facing the photosensitive drum 1. Then, the toner carried on the peripheral surface is transferred to the latent image in the electric field so as to form a visible image.

The transfer roller 5 includes a metal shaft and a semiconductive rubber layer on an outer peripheral surface of the metal shaft. The semiconductive rubber layer has a about several millimeters in thickness. The transfer roller 5 abuts against the peripheral surface of the photosensitive drum 1 and rotates while following the rotation of the photosensitive drum 1. A recording medium transported to a portion between the transfer roller 5 and the photosensitive drum 1 abuts against the toner image on the photosensitive drum 1. Then, the toner having charges is transferred onto the recording medium by action of the electric field formed between the transfer roller 5 and the photosensitive drum 1.

Figure 2:
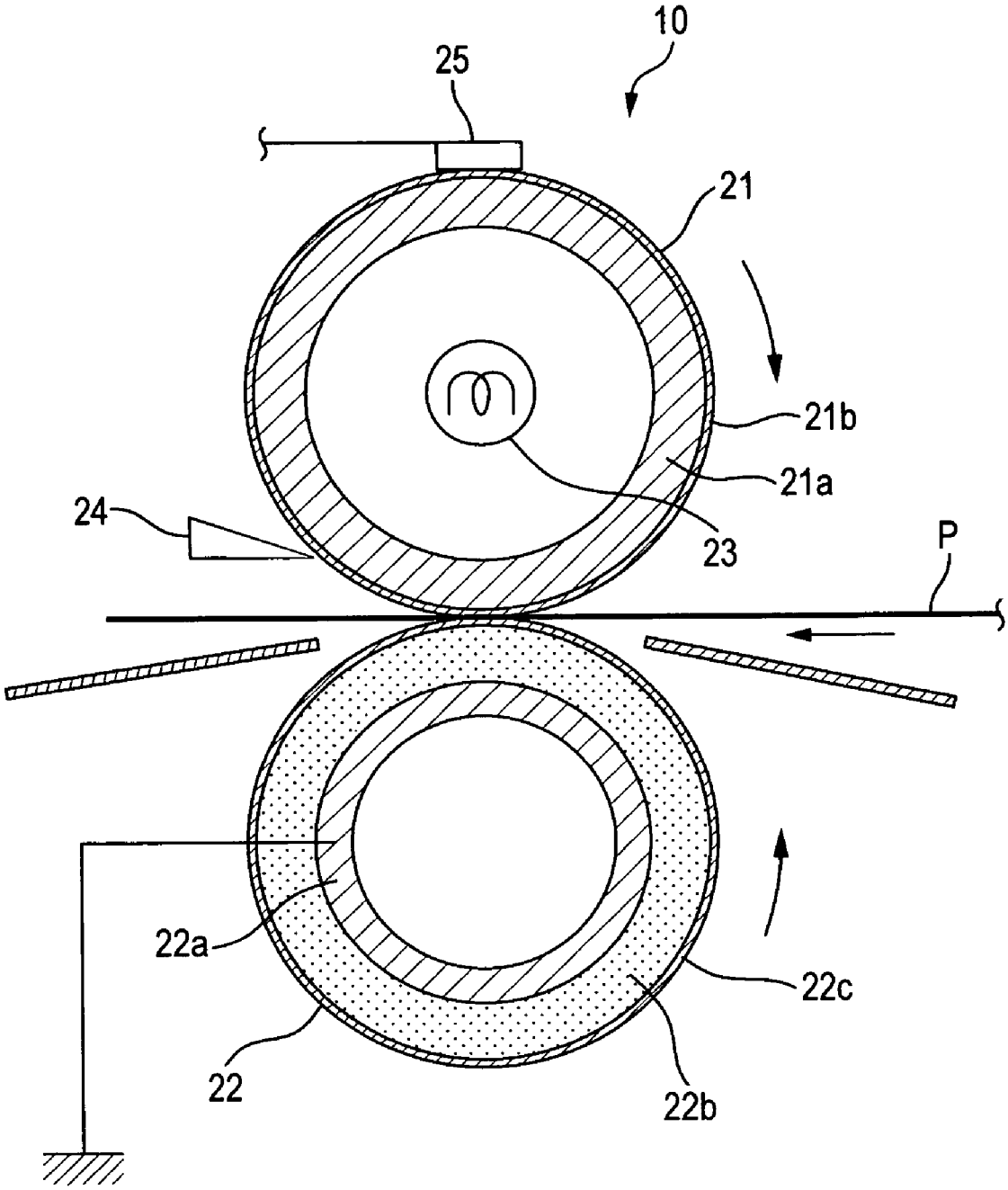
FIG. 2 is a schematic configuration drawing of a fixing device according to a first exemplary embodiment of the invention, for use in the image forming apparatus shown in FIG. 1.

The fixing device 10 has a heating roller 21 and a pressurization roller 22 as shown in FIG. 2. The heating roller 21 contains a halogen lamp 23 serving as a heat source. The pressurization roller 22 is in pressure-contact with the heating roller 21. The heating roller 21 is rotated at a circumferential velocity of 460 mm/sec through a drive transmission mechanism such as a gear (not shown). The pressurization roller 22 rotates while following rotation of the heating roller 21. The heating roller 21 and the pressurization roller 22 are in pressure-contact with each other at pressure of 2.352 KN (240 Kgf). The nip portion the having a width of about 9 mm is formed in a circumferential direction between the heating roller 21 and the pressurization roller 22.

A separation claw 24 is disposed on the downstream side of the fixing nip portion 10*a* where the heating roller 21 and the pressurization roller 22 are in pressure-contact with each other. The separation claw 24 prevents a recording medium P from winding around the heating roller 21. A thermistor 25 serving as a temperature detection device is disposed on the peripheral surface of the heating roller 21. Turning on/off of the halogen lamp 23 is controlled based on the detection temperature of the thermister 25. Accordingly, the surface temperature of the heating roller 21 is controlled so as to be at about 180° C.

The heating roller 21 includes a hollow cylindrical cored bar 21*a* and a surface release layer 21*b*. The cored bar 21*a* may have 350 mm in length and 65 mm in diameter, and may be made of aluminum having 5 mm in thickness. The surface release layer 21*b* is formed on the outer peripheral surface of the cored bar 21*a*. The surface release layer 21*b* is formed by baking a PFA resin so as to have 30 μm in thickness. 10 wt % silicon carbide having 5 μm in average particle diameter is mixed into the PFA resin forming the surface release layer 21*b* as a abrasion-resistant filler. The mixed silicon carbide prevents the surface of the heating roller 21 from being worn by friction with the transported recording media. As the abrasion-resistant filler, metal particles such as alumina particles may also be used.

On the other hand, the pressurization roller 22 has a cored bar 22*a*, which is a metal cylindrical member, and an elastic layer 22*b* (layer disposed just below a surface layer 22*c*) made of sponge or rubber, and the surface layer 22*c*. The elastic layer 22*b* is formed on the surface of the cored bar 22*a*. The surface layer 22*c* is made of a PFA resin. In this exemplary embodiment, the cored bar 22*a* includes a steel member, which has 350 mm in length and 41 mm in diameter. The steel member is plated. The elastic layer 22*b* (layer disposed just below the surface layer 22*c*) is made of porous silicone rubber having 12 mm in thickness and 60 degrees (JIS-A) in rubber hardness. A conductive filler is dispersed in and mixed in the elastic layer 22*b* (layer disposed just below the surface layer 22*c*) so that volume resistance of the elastic layer 22*b* is equal to about $10^6\Omega$. The cored bar 22*a* is electrically grounded.

The surface layer 22*c* is formed by coating the elastic layer 22*b* (layer disposed just below the surface layer 22*c*) with a tube-like PFA resin having 100 μm in thickness. A conductive filler such as carbon particles is dispersed in the surface layer 22*c* so that volume resistance of the surface layer 22*c* is equal to about $10^9\Omega$.

In this exemplary embodiment, the volume resistance of the elastic layer 22*b* and the volume resistance of the surface layer 22*c* are adjusted as mentioned above. However the resistance value of the surface layer 22*c* may be selected from a range of $10^7\Omega$ to $10^{14}\Omega$ appropriately. Also, the resistance value of the layer disposed just below the surface layer (e.g., the elastic layer 22*b*) may be selected from a range less than $10^7\Omega$ appropriately.

When the volume resistance of the surface layer is in a range of $10^7\Omega$ to $10^{14}\Omega$ and the volume resistance of the layer disposed just below the surface layer is less than $10^7\Omega$, charges produced by frictional electrification on the surface are easily eliminated to ground and occurrence of inductive charges, on the surface, having the opposite polarity to that of the recording medium is suppressed effectively.

The "volume resistance of the surface layer" refers to the resistance value possessed by the surface layer when a current flows into ground from the pressure-contact portion between the heating rotation body and the pressurization member. Also, the "volume resistance of the layer disposed just below the surface layer" refers to the resistance value possessed by the layer disposed just below the surface layer when a current flows into ground from the pressure-contact portion. This definitions of those terms will be applied to other portions of this specification.

In this exemplary embodiment, the thickness of the surface layer 22*c* made of a PFA resin is equal to 100 μm. However, the surface layer 22*c* needs only to have a thickness of about 10 μm or more. Therefore, the thickness of the surface layer 22*c* may be set appropriately so long as the volume resistance of the surface layer 22*c* is in the above described range when current flows into the cylindrical cored bar 22*a* from the pressure-contact portion between the pressurization roller 22 and the heating roller 21.

The above-described image forming apparatus operates as follows.

The charging device 2 charges the photosensitive drum 1 almost uniform to have minus polarity. The exposure device 3 applies the image light to the charged peripheral surface of the photosensitive drum 1 based on the image data. The charge potential attenuates in the exposed portion of the surface of the photosensitive drum 1, so that a latent image is formed based on the potential difference between the exposed portion and a non-exposed portion. The developing device 4 carries a thin layer of toner having minus charges on the peripheral surface of the developing roller 4*a* and transports the toner to a position facing the peripheral surface of the photosensitive drum 1. An electric field is formed by a developing bias voltage, which is applied to a portion between the developing roller 4*a* and the photosensitive drum 1. The toner having the minus charges is transferred to the exposed portion. The photosensitive drum 1 rotates to transport the toner image thus formed to a transfer nip 5*a* where the transfer roller 5 is in pressure-contact with the photosensitive drum 1.

On the other hand, the registration roller 9 temporarily holds a recording medium fed one by one from the paper tray 7 and then transports the recording medium to the transfer nip 5*a* at such a timing that the recording medium will be in contact with the toner image carried on the photosensitive drum 1. The recording medium comes in contact with the surface of the photosensitive drum 1 on the upstream portion of the transfer nip 5*a* and passes through the transfer nip 5*a* while be in close contact with the surface of the photosensitive drum 1.

An electric field is formed in the transfer nip 5*a* and in the vicinity of the transfer nip 5*a* by the developing bias voltage. The toner image is transferred to the recording medium within this electric field.

Then, discharge occurs when the recording medium carrying the toner image thereon is peeled off from the transfer roller 5. This discharge gives plus charges to the recording medium. The recording medium is transported to the fixing device 10 with the toner image held on the recording medium. In the fixing device 10, the recording medium P carrying the toner image thereon is clamped in the fixing nip portion 10*a* between the heating roller 21 and the pressurization roller 22. The toner brought into pressure-contact with the heating roller 21 is heated and fused. As a result, the toner is fixed onto the recording medium P. The recording medium P passing through the fixing nip portion 10*a* is peeled off from the heating roller 21 or the pressurization roller 22, and is transported to the paper discharge roller 11.

As described above, in the step of fixing the toner image, the minus-charged toner passes through the nip portion in a state where the toner is attracted to the recording medium P having the plus charges. The volume resistance of the surface layer 22*c* of the pressurization roller 22 is adjusted to have $10^9\Omega$ and the volume resistance of the layer 22*b* just below the surface is adjusted to have $10^6\Omega$. Therefore, the surface layer 22*c* is hardly charged by friction with the recording medium P. Even if charges occur, electricity is removed by grounding through the layer 22*b* disposed just below the surface layer 22*c* having high electric conductivity.

Further, the surface layer 22*c* of the pressurization roller 22 has $10^9\Omega$ in the volume resistance set to a slightly high value and has 10 μm or more in thickness. Thus, inductive charges do not occur on the surface of the pressurization roller 22 by the charges possessed by the recording medium P.

Next, experiment conducted using the above-described image forming apparatus to confirm advantages of the first exemplary embodiment will be described.

Table 1 shows a result of comparing offset occurrence state when toner images are fixed using the fixing device 10 according to the first exemplary embodiment and a fixing device of a comparative example.

The fixing device of the comparative example used in the experiment includes the same heating roller as the fixing device 10 according to the first exemplary embodiment. On the other hand, a pressurization roller of the fixing device of the comparative example has a cylindrical cored bar; a heat-resistant elastic layer made of silicon rubber on the cylindrical cored bar; and a surface layer made of a conductive PFA resin having volume resistance adjusted to $10^5\Omega$ on the elastic layer. The surface layer is electrically grounded.

Figure 5:
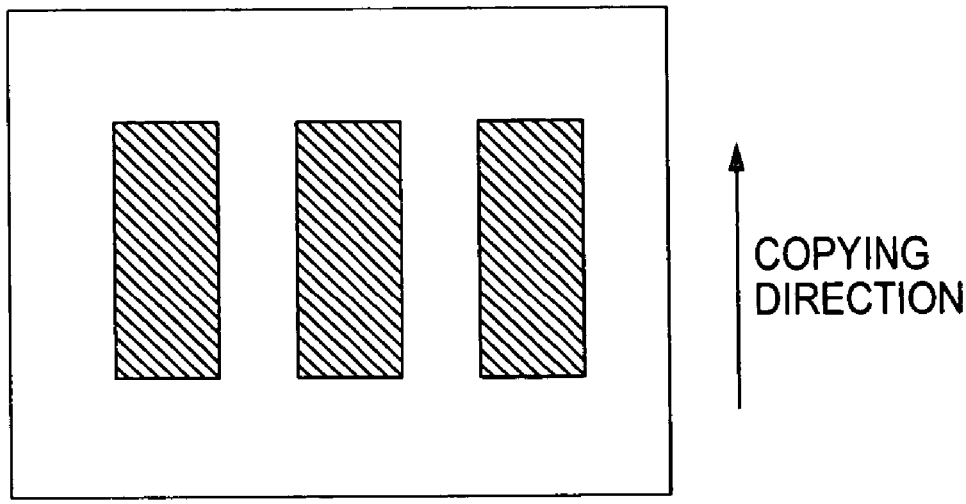
FIG. 5 is a drawing to show an original image used for an experiment of checking advantages of the image forming apparatus according to the exemplary embodiments.

Predetermined number of sheets of paper each formed with an image shown in FIG. 5 are continuously passed through each of the fixing devices. A4 size paper GREEN100 manufactured by Fuji Xerox Office Supply Co. Ltd. is used as the record media and is fed into the fixing device with its long side located in a leading edge. After the predetermined number of sheets of paper are fixed, a fully halftone image at an image density of 50% is formed on a sheet of paper. Then, the sheet of paper is passed through the fixing device and an offset occurrence state is observed.

As the results of the experiment, offset occurs in the fixing device of the comparative example after continuous copy of 10,000 sheets of paper. Whereas, toner offset does not occur in the fixing device 10 according to the first exemplary embodiment even after continuous copy of 100,000 sheets of paper or more, as shown in Table 1. In the heating roller 21 after copy of 100,000 sheets of paper or more, abrasion of the surface release layer 21*b* is 10 μm or less and a good condition is kept.

Therefore, the fixing device 10 according to the first exemplary embodiment can suppress toner offset and decrease abrasion of the surface of the heating roller.

TABLE 1

| Number of copies | Comparative example | first exemplary embodiment |
|---|---|---|
| 5,000 | Not offset | Not offset |
| 10,000 | Offset occurs | Not offset |
| 50,000 | Offset occurs | Not offset |
| 100,000 | Offset occurs | Not offset |

Next, an image forming apparatus according top a second exemplary embodiment of the invention will be described.

Figure 3:
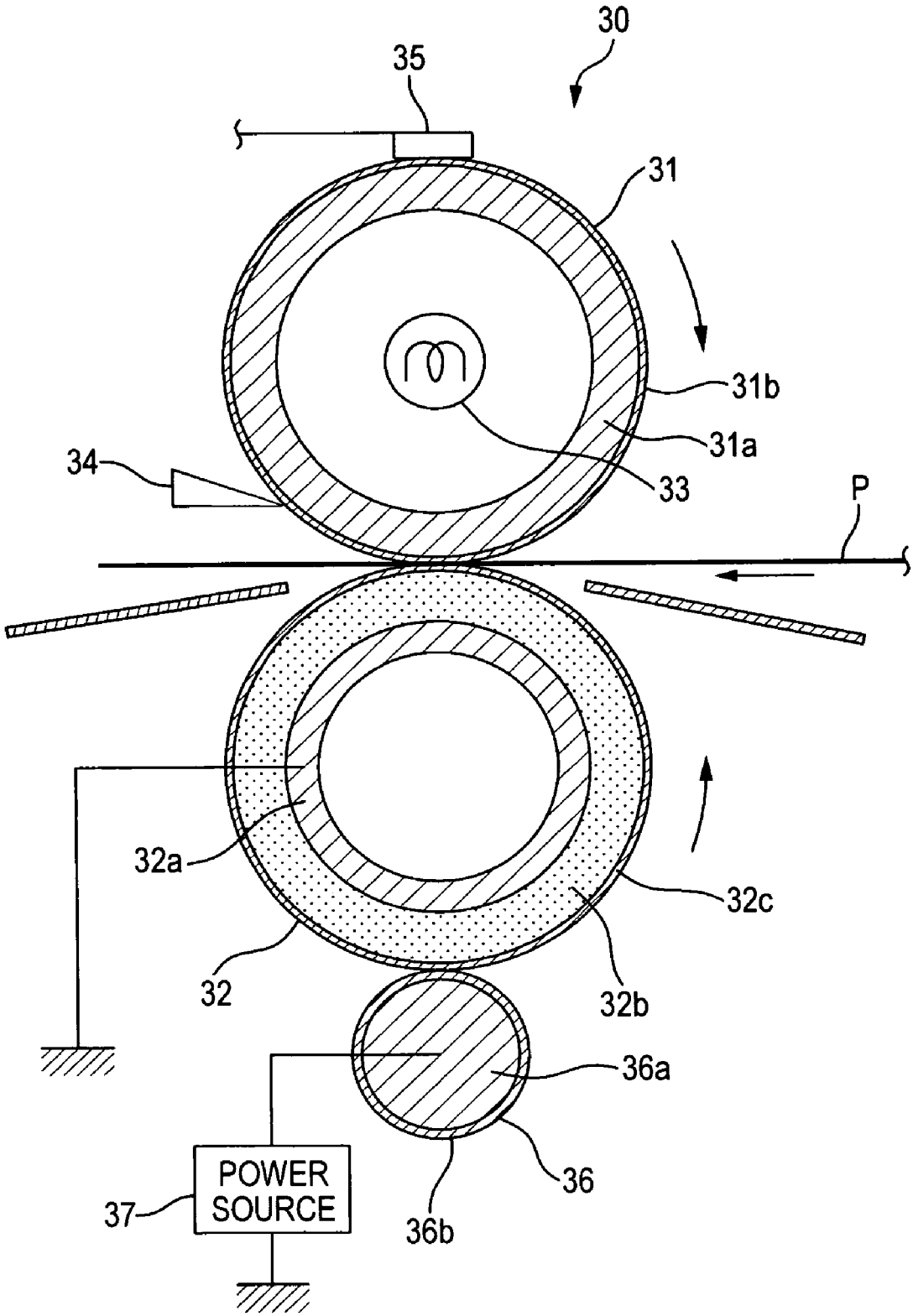
FIG. 3 is a schematic configuration drawing of a fixing device according to a second exemplary embodiment of the invention.

The image forming apparatus includes a fixing device 30 shown in FIG. 3 in place of the fixing device 10 used in the image forming apparatus shown in FIG. 1. The structure of the image forming apparatus other than the fixing device 30 is the same as the structure of the image forming apparatus shown in FIG. 1. Therefore, duplicate description will be omitted.

The fixing device 30 includes a heating roller 31 and a pressurization roller 32 as shown in FIG. 3. The heating roller 31 contains a halogen lamp 33 serving as a heat source. The pressurization roller 32 is in pressure-contact with the heating roller 31. The heating roller 31 is rotated at a circumferential velocity of 460 mm/sec. The pressurization roller 32 rotates while following rotation of the heating roller 31. The heating roller 31 and the pressurization roller 32 are in pressure-contact with each other at pressure of 2.352 KN (240 Kgf). A nip portion having about 9 mm in width of about is formed between the heating roller 31 and the pressurization roller 32, as in the fixing device 10 shown in FIG. 2. A static elimination roller 36 abuts against the peripheral surface of the pressurization roller 32. The pressurization roller 32 drives the static elimination roller 36.

The heating roller 31 has the same configuration as that of the fixing device 10 shown in FIG. 2.

The pressurization roller 32 has a cored bar 32*a*, which is a metal cylindrical member. An elastic layer 32*b* (layer disposed just below a surface layer 32*c*) and a surface layer 32*c* made of a PFA resin are disposed on the surface of the cored bar 32*a*. The diameter of the cored bar 32*a* (41 mm), the thickness (12 mm) and the rubber hardness (60 degrees) and the thickness of the surface layer 32*c* (100 μm) are the same as those of the fixing device 10 shown in FIG. 2. The elastic layer 32*b* is formed by dispersing and mixing carbon particles of a conductive filler in and with silicone rubber and is adjusted so that volume resistance of the elastic layer 32*b* is equal to about $10^6\Omega$. The cylindrical cored bar 32*a* for supporting the elastic layer 32*b* is electrically grounded.

The surface layer 32*c* of the pressurization roller 32 used in the fixing device 30 is formed of a tube-like PFA resin having 100 μm in thickness. However, unlike that in the fixing device 10 shown in FIG. 2, a conductive filler such as carbon particles is not dispersed in the surface layer 32*c*. Also, the volume resistance of the surface layer 32*c* is set to $10^{16}\Omega$ or more.

The static elimination roller 36 includes a conductive metal roller 36*a* and a surface layer 36*b*. The conductive metal roller 36*a* may be made of stainless steel or aluminum. The surface layer 36*b* is made of a PFA resin having 50 μm in thickness and is formed on the outer peripheral surface of a metal roller 36*a*. The metal roller 36*a* has 350 mm in length and 10 mm in diameter. Carbon particles are mixed into the PFA resin of the surface layer 36*b* so as to adjust volume resistance of the surface layer 36*b* to $10^5\Omega$. An AC voltage having peak voltage 250 V is applied to the metal roller 36*a* from a power supply 37 so as to adjust the surface potential of the pressurization roller 32 to almost 0 volt.

In the fixing device 30, the surface layer 32*c* of the pressurization roller 32 is strongly charged to the negative polarity by friction between a recording medium P and the surface layer 32*c* of the pressurization roller 32. However, the static elimination roller 36 eliminates charges and therefore, the surface potential of the pressurization roller 32 is maintained at almost 0 volt. As a result, minus-charged toner carried on the recording medium P is attracted to the recording medium P having plus charges and passes through the pressure-contact portion (nip portion) without receiving the effect of the charges possessed by the pressurization roller 32. Paper dust existing detachably on the back of the recording medium P has plus charges like the recording medium P. However, the surface of the pressurization roller 32 is subjected to static elimination and thus does not attract the paper power of the plus polarity. Further, the surface layer 32*c* of the pressurization roller 32 has a large resistance value. When the recording medium P having plus charges passes through the pressure-contact portion between the heating roller 31 and the pressurization roller 32, minus charges caused by electrostatic induction do not occur in the vicinity of the surface of the pressurization roller 32.

A similar experiment to that using the fixing device 10 shown in FIG. 2 is also conducted with using the fixing device 30. It is confirmed that the fixing device 30 noticeably decreases toner offset in comparison with the fixing device of the comparative example.

Next, an image forming apparatus according to a third exemplary embodiment of the invention will be described.

Figure 4:
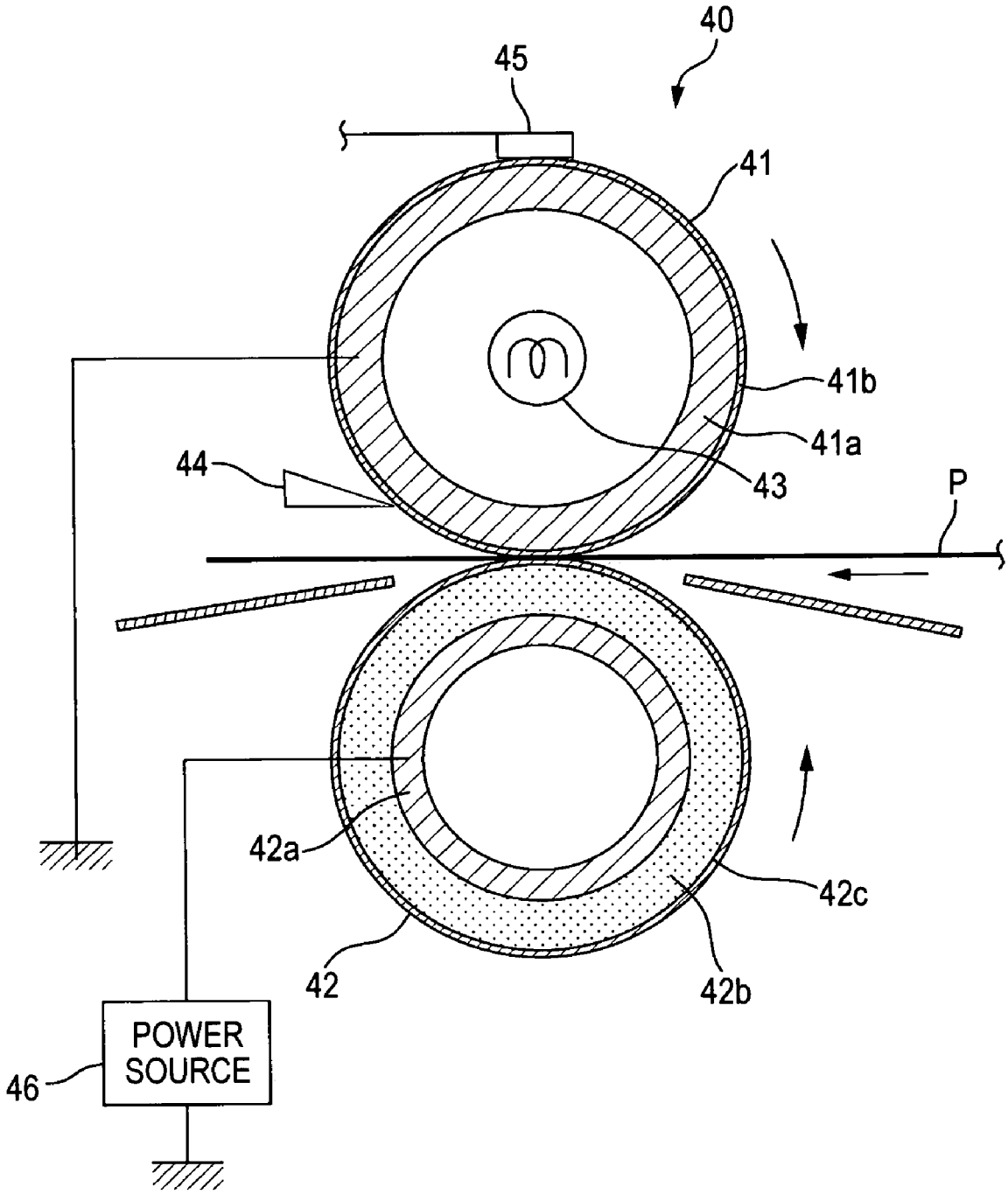
FIG. 4 is a schematic configuration drawing of a fixing device according to a third exemplary embodiment of the invention.

The image forming apparatus uses a fixing device 40 shown in FIG. 4 in place of the fixing device 10 of the image forming apparatus shown in FIG. 2. The structure of the image forming apparatus other than the fixing device 40 is the same as the configuration of the image forming apparatus shown in FIG. 1.

The fixing device 40 used in this image forming apparatus has the same configuration as that of the fixing device 10 shown in FIG. 2, and the followings are added.

A heating roller 41 is the same as that of the fixing device 10 shown in FIG. 2, except that a cylindrical cored bar 41*a* is electrically grounded. Also, a cylindrical cored bar 42*a* of a pressurization roller 42 is connected to a bias power supply 46 rather than grounded. A voltage of +250 volts is applied to the cored bar 42*a* as a voltage of the opposite polarity to toner. The voltage is applied to the pressurization roller 42 at the timing when a recording medium P is fed into the fixing device 40, and an electric field is formed between the heating roller 41 and the pressurization roller 42 only while the recording medium P is passing through the press portion between the heating roller 41 and the pressurization roller 42.

A similar experiment to that using the fixing device shown in FIG. 3 is also conducted with using the fixing device 40. Then, better results are obtained than that obtained through the experiment using the fixing device shown in FIG. 3.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a heating rotation body comprising an endless peripheral surface that moves circularly;

a heat source that heats the heating rotation body; and a pressurization member that is in pressure-contact with the peripheral surface of the heating rotation body to press a recording medium, which passes through a nip between the pressurization member and the heating rotation body, against the peripheral surface of the heating rotation body, wherein:

the pressurization member comprises:

a base material; and a plurality of layers deposited on the base material, a volume resistance of a surface layer forming a surface of the pressurization member is larger than that of a layer disposed just below the surface layer, and the layer disposed just below the surface layer is grounded.

2. A fixing device comprising:

a heating rotation body comprising an endless peripheral surface that moves circularly;

a heat source that heats the heating rotation body; and a pressurization member that is in pressure-contact with the peripheral surface of the heating rotation body to press a recording medium, which passes through a nip between the pressurization member and the heating rotation body, against the peripheral surface of the heating rotation body, wherein:

the pressurization member comprises:

a base material; and a plurality of layers deposited on the base material, a volume resistance of a surface layer forming a surface of the pressurization member is $10^9\Omega$, a volume resistance of a layer disposed just below the surface layer is $10^6\Omega$, and the layer disposed just below the surface layer is grounded.

3. The fixing device according to claim 1, wherein:

the volume resistance of the surface layer of the pressurization member is in a range of $10^7\Omega$ to $10^{14}\Omega$, and the volume resistance of the layer disposed just below the surface layer is less than $10^7\Omega$.

4. The fixing device according to claim 1, wherein:

the heating rotation body comprises a surface release layer that forms a surface of the heating rotation body, and an abrasion-resistant filler is mixed with the surface release layer of the heating rotation body.

5. The fixing device according to claim 4, wherein the abrasion-resistant filler is silicon carbide.

6. The fixing device according to claim 4, wherein the abrasion-resistant filler is a conductive filler.

7. The fixing device according to claim 4, wherein the abrasion-resistant filler is alumina.

8. A fixing device comprising:

a heating rotation body comprising an endless peripheral surface that moves circularly;

a heat source that heats the heating rotation body;

a pressurization member that is in pressure-contact with the peripheral surface of the heating rotation body to press a recording medium, which passes through a nip between the pressurization member and the heating rotation body, against the peripheral surface of the heating rotation body; and a static elimination unit that eliminates electricity on a surface of the pressurization member, wherein:

the pressurization member comprises:

a base material; and a plurality of layers deposited on the base material, a volume resistance of a surface layer forming the surface of the pressurization member is larger than $10^{16}\Omega$, and a volume resistance of a layer disposed just below the surface layer is less than $10^8\Omega$.

9. The fixing device according to claim 8, wherein the static elimination unit applies an AC bias voltage to the pressurization member.

10. The fixing device according to claim 8, wherein:

the heating rotation body comprises a surface release layer that forms a surface of the heating rotation body, and an abrasion-resistant filler is mixed into the surface release layer of the heating rotation body.

11. A fixing device comprising:

a heating rotation body comprising an endless peripheral surface that moves circularly;

a heat source that heats the heating rotation body; and a pressurization member that is in pressure-contact with the peripheral surface of the heating rotation body to press a recording medium, which passes through a nip between the pressurization member and the heating rotation body, against the peripheral surface of the heating rotation body, wherein:

the heating rotation body comprises:

a conductor; and a surface release layer, the conductor is disposed inside the surface release layer and is grounded, the pressurization member comprises:

a base material; and a plurality of layers deposited on the base material, a volume resistance of a surface layer forming a surface of the pressurization member is larger than that of a layer disposed just below the surface layer, and a voltage having a polarity opposite to a charge of a toner is applied to the layer disposed just below the surface layer.

12. The fixing device according to claim 11, wherein:

the volume resistance of the surface layer of the pressurization member is in a range of $10^7\Omega$ to $10^{14}\Omega$, and the volume resistance of the layer disposed just below the surface layer is less than $10^7\Omega$.

13. The fixing device according to any one of claims 11, wherein the voltage is applied to the layer disposed just below the surface layer of the pressurization member only while the recording medium is passing through a pressure-contact portion between the heating rotation body and the pressurization member.

14. The fixing device according to claim 11, wherein an abrasion-resistant filler is mixed into the surface release layer of the heating rotation body.

15. The fixing device according to claim 14, wherein the abrasion-resistant filler is silicon carbide.

16. The fixing device according to claim 14, wherein the abrasion-resistant filler is a conductive filler.

17. The fixing device according to claim 14, wherein the abrasion-resistant filler is alumina.

18. An image forming apparatus comprising:

an image forming unit that selectively deposits powder toner on a latent image formed by an electrostatic potential difference so as to form a toner image;

a transfer unit that transfers the toner image directly or through an intermediate transfer body to a recording medium; and a fixing device that heats and pressurizes the toner image transferred onto the recording medium to fix the toner image onto the recording medium, wherein:

the fixing device is a fixing device according to claim 1.

* * * * *